US006389615B2

(12) United States Patent
Perrier

(10) Patent No.: US 6,389,615 B2
(45) Date of Patent: May 21, 2002

(54) FAIL-SAFE SAFETY SWIMMING POOL NET

(76) Inventor: Gregory Perrier, 280 Half Hollow Rd., Dix Hills, NY (US) 11746

( * ) Notice: Subject to any disclaimer, the term of this patent is extended or adjusted under 35 U.S.C. 154(b) by 0 days.

(21) Appl. No.: 09/872,032

(22) Filed: Jun. 1, 2001

Related U.S. Application Data

(60) Provisional application No. 60/209,160, filed on Jun. 2, 2000.

(51) Int. Cl.[7] ..... E04H 4/06
(52) U.S. Cl. ..... 4/495; 4/504
(58) Field of Search ..... 4/495, 504

(56) References Cited

U.S. PATENT DOCUMENTS

| | | | | |
|---|---|---|---|---|
| 1,091,909 | A | 3/1914 | Birmingham | |
| 1,796,762 | A | 3/1931 | Paston | |
| 2,812,520 | A | 11/1957 | Pinckard | 4/172 |
| 2,970,320 | A | 2/1961 | Karp | 4/172 |
| 3,000,017 | A | 9/1961 | Skovira | 4/172 |
| 3,413,661 | A | 12/1968 | Ross | 4/172 |
| 3,423,768 | A | 1/1969 | Glenn | 4/172 |
| 3,668,711 | A | 6/1972 | Liermann | 4/172.13 |
| 3,760,432 | A | 9/1973 | Glorisi | 4/172.13 |
| 3,813,704 | A | 6/1974 | Troiano | 4/172.13 |
| 3,889,303 | A | 6/1975 | Kinzel | 4/172.13 |
| 3,955,797 | A | 5/1976 | Richards | 254/89 H |
| 4,000,527 | A | 1/1977 | Gannon | 4/172.12 |
| 4,129,905 | A | 12/1978 | Niemirow | 4/172.13 |
| 4,151,617 | A | 5/1979 | Kinzel | 4/172.14 |
| 4,181,986 | A | 1/1980 | Aine | 4/172.14 |
| 4,236,258 | A | 12/1980 | Batstone | 4/501 |
| 4,271,542 | A | 6/1981 | Wood et al. | 4/495 |
| 4,747,168 | A | 5/1988 | Sing | 4/504 |
| 5,019,802 | A | 5/1991 | Brittain et al. | 340/522 |
| 5,023,593 | A | 6/1991 | Brox | 340/522 |
| 5,091,714 | A | 2/1992 | de Solminihac | 340/573 |
| 5,267,358 | A | 12/1993 | Roy et al. | 4/504 |
| 5,484,313 | A | 1/1996 | Rachal et al. | 441/80 |
| 5,832,547 | A | 11/1998 | Burroughs | 4/504 |
| 6,127,930 | A | 10/2000 | Steffanus | 340/573 |

*Primary Examiner*—Charles E. Phillips
(74) *Attorney, Agent, or Firm*—Alfred M. Walker

(57) ABSTRACT

A swimming pool rescue apparatus includes a safety pool bottom substrate, having a periphery made of a buoyant material and at least one non-peripheral portion is buoyant. The buoyant material is urged into a fixed position at a bottom of the pool by a retaining member. A lifting mechanism raises and lowers the safety pool bottom substrate. The lifting mechanism communicates with a detection signal device detecting the presence of a person under water in the pool for a predetermined period of time. The electronic signal device has a trigger engaging the lifting mechanism to release the buoyant material from a fixed position at the bottom of the pool to a further position at an upper area above the water level of the pool.

15 Claims, 5 Drawing Sheets

FAIL-SAFE SAFETY SWIMMING POOL NET

This application claims benefit of provisonal application 60/209,160 filed Jun. 2, 2000.

FIELD OF THE INVENTION

The present invention relates to swimming pool rescue devices.

BACKGROUND OF THE INVENTION

Safety swimming pool nets have been represented in the prior art as discussed in the background to this invention. Both hydraulic and mechanical means have been described for raising a net at the bottom of a pool during a potential drowning emergency.

In these cases, the power requirements for performing this task are high since time is of the essence in raising a swimmer in distress to safety. The mechanisms must raise the weight of the potential victim as well as the weight of the net structure and net through resisting water in a short time.

To increase reliability, it is desirable to have redundant power sources and/or an uninterruptable power supply (UPS) to power such a safety system during a power outage. With high power/energy requirements, this is an expensive proposition.

One prior art system uses a submerged inflatable bladder and a storage tank filled with compressed air to quickly inflate the bladder thereby lifting the submerged safety net during an emergency. While fast acting in an emergency, the reliability of rubber-like inflatable bladders over long dormant periods is questionable. The difficulty in deflating such a bladder after use makes it unlikely that safety checks by deployment at scheduled intervals would be actually performed. Also, the requirement of a large diameter hose and an enormous air valve orifice to facilitate rapid inflation have adverse aesthetic and cost consequences.

OBJECTS AND SUMMARY OF THE INVENTION

It is therefore an object of the present invention to provide a reliable device for bringing non-swimmer quickly to the surface of a swimming pool.

In keeping with these objects and others which may become apparent, this invention uses a permanently buoyant safety net structure to avoid many of the shortcomings of the prior art. The only negative aspect of such an approach is the reduction of usable pool depth by three to five inches (76 to 127 mm); this seem to be a small price to pay for the benefits to be described. Mechanisms are used to force the net structure to a ready position at the bottom of the pool and keep it in a ready position for deployment in case of emergency. The buoyant force of the net structure must accommodate lifting a potential victim or victims as well as the net structure itself in a timely manner while encountering water resistance. Thus the potential energy of a submerged buoyant net structure is substantial. This must be provided by the submerging mechanisms after a deployment during a system test or actual emergency. However, this energy can be supplied at a slow rate (i.e.—low power) since this is not an emergency situation.

The latter means that system cost can be reduced as compared to prior art systems since lower power mechanisms with low power wiring or piping requirements are used. Another factor is that there is no reason for a redundant or UPS power supply for this substantial energy requirement since it is not needed during an emergency situation. The very low energy required to trigger deployment of the buoyant submerged safety net can easily be supplied by a small UPS or alternate redundant power supply. This increases system emergency reliability by facilitating the incorporation of such redundant features since the cost for a triggering UPS is low due to its modest energy storage and power requirements.

Finally, the system is fail-safe in the sense that a faulty trigger failing in the false-trigger mode would cause the net to rise in the vicinity of the failed mechanism. This also provides visual cues to a potential problem that can be repaired. The reliability design of actual components must be concerned with jamming of the deployment trigger mechanism and subsystem which is primarily a materials problem to be avoided through accelerated life testing and scheduled routine testing of the entire system by the pool owner. Thus from a system reliability design point of view, the actual design is biased toward false triggering since this is the fail-safe situation.

The safety net of this invention floats about three inches (76 mm) above the surface of the water when floating. In this position, it serves as a protective covering over the entire pool during periods when the pool is not in use or is unattended. By positioning submerging mechanisms where needed along the periphery of the pool, any shape pool can be accommodated even with multiple levels. With the safety net in the floating position, sections can be removed from the attachment to the submerging mechanisms and folded back to permit cleaning, maintenance and repairs of the pool bottom. For security, a wrench with a matching female configuration to special screw heads should be used to prevent unauthorized detachment of the safety net.

BRIEF DESCRIPTION OF THE DRAWINGS

The present invention can best be understood in conjunction with the accompanying drawings, in which.

DETAILED DESCRIPTION OF THE INVENTION

Figure 1:
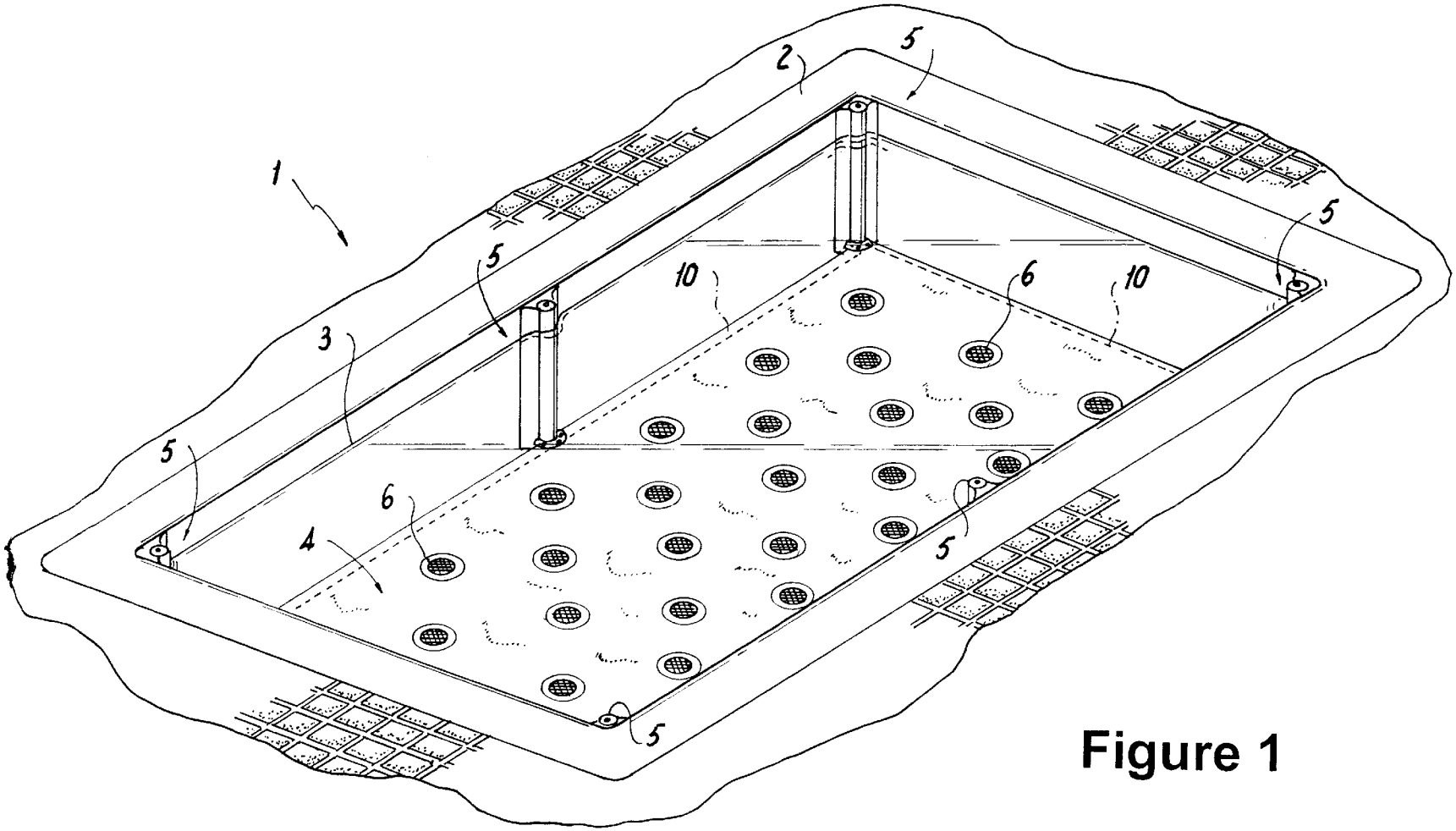
FIG. 1 is a top perspective view of a pool with another embodiment for a safety net of this invention.

FIG. 1 shows pool 1 with submerged buoyant safety bottom 4 held down by hydraulic submerging mechanisms 5. Water level is shown at 3. A rigid non-buoyant material is depicted for safety bottom 4, peripheral floats 10 are illustrated. Additional floatation is provided as a thick ring of floatation material at the site of each of the circular drains 6 which are distributed over the surface.

The material of bottom 4 is preferably a fiber reinforced light weight plastic sheet. Each of the drain rings 6 is sealed with wire or plastic mesh with openings of the order of ½" (12.7 mm) or less precluding entanglement of fingers or toes.

The distribution of edge 10 and central 6 floatation insures that the weight distribution of a disabled person on a floating safety bottom 4 would not cause any part of the person's body to sink below the surface of the water.

The buoyant material is a rigid closed cell foam as used in marine floatation safety devices; it must also have a skin that is resistant to chlorine as is often used in pools. Material with a specific gravity of 0.25 provides the minimal required peripheral floatation 10 in a mere 3" diameter (76 mm) tubular form (although this would not be the ideal crossection shape) if the area density of the bottom 4 sheeting is of the order 0.2 pounds per square foot (977 gm/square meter).

Figure 2:
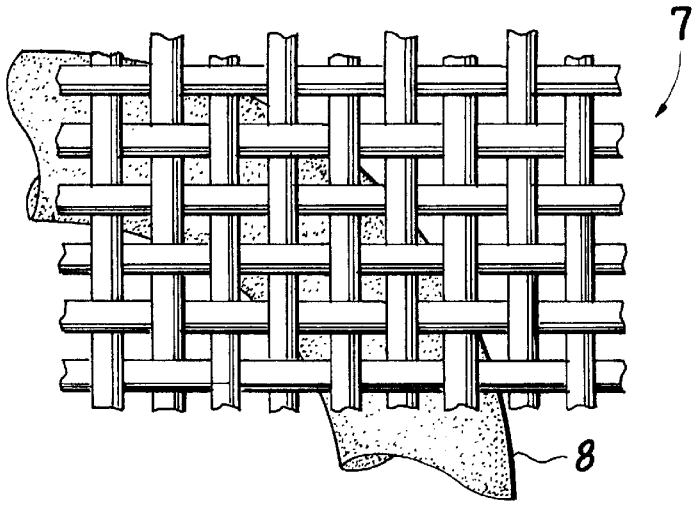
FIG. 2 is a top detail view of a detail of a woven net material of this invention.

FIG. 2 shows a detail of an alternative more flexible woven material 7 with a floatation device 8 attached below for a safety pool bottom; it is a true net. Flat fiber reinforced plastic straps or even buoyant tubular members can be woven. A 25% open weave wherein the warp and weft strands are bonded at each intersection is strongly suggested. The open weave permits easy drainage; the openings should be kept to ½" squares (12.7 mm) or smaller to prevent entanglement of fingers or toes. The bonding prevents shifting of the strands.

Figure 3:
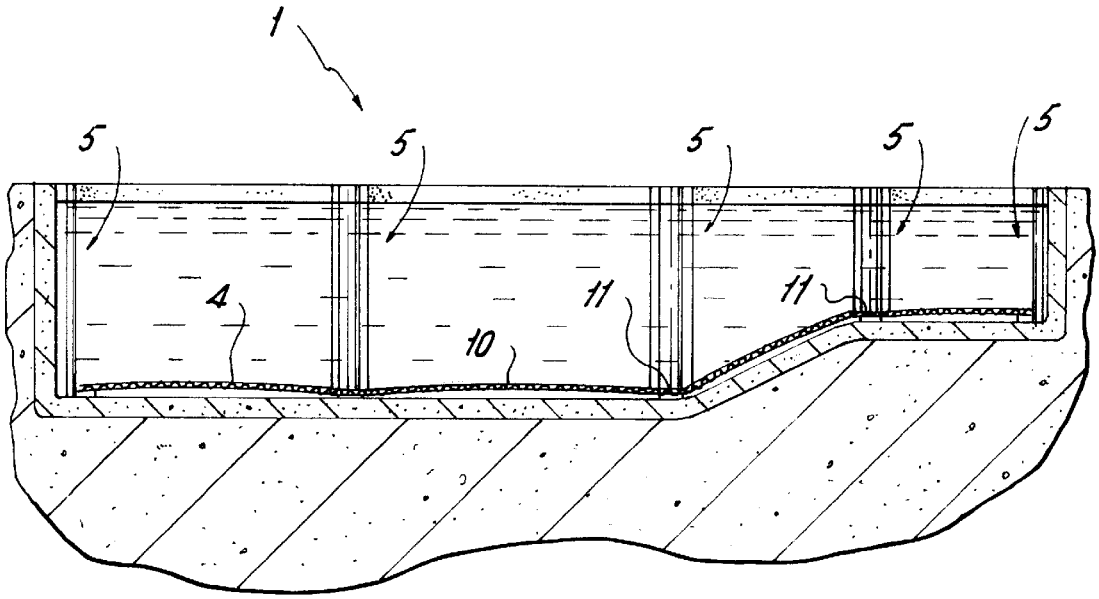
FIG. 3 is a side elevational view in crossection of a pool with the safety net of this invention.

FIG. 3 shows a crossection of a pool 1 with different depths. Submerging mechanisms 5 are positioned at inflection points in the bottom contour. Also, their length is related to the local depth. The material of the safety pool bottom 4 must have a flexible seam at the inflection point if it is of a rigid material.

Figure 4:
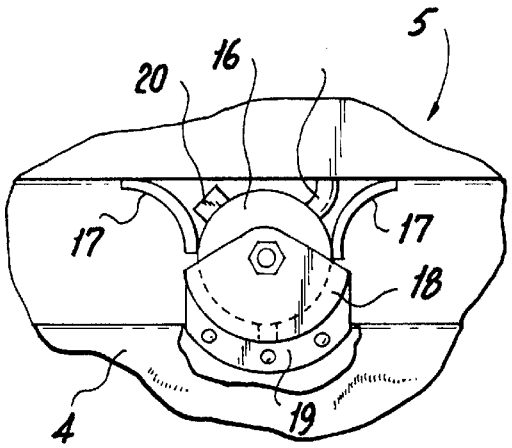
FIG. 4 is a top plan view of a hydraulic submerging mechanism of this invention.
Figure 5:
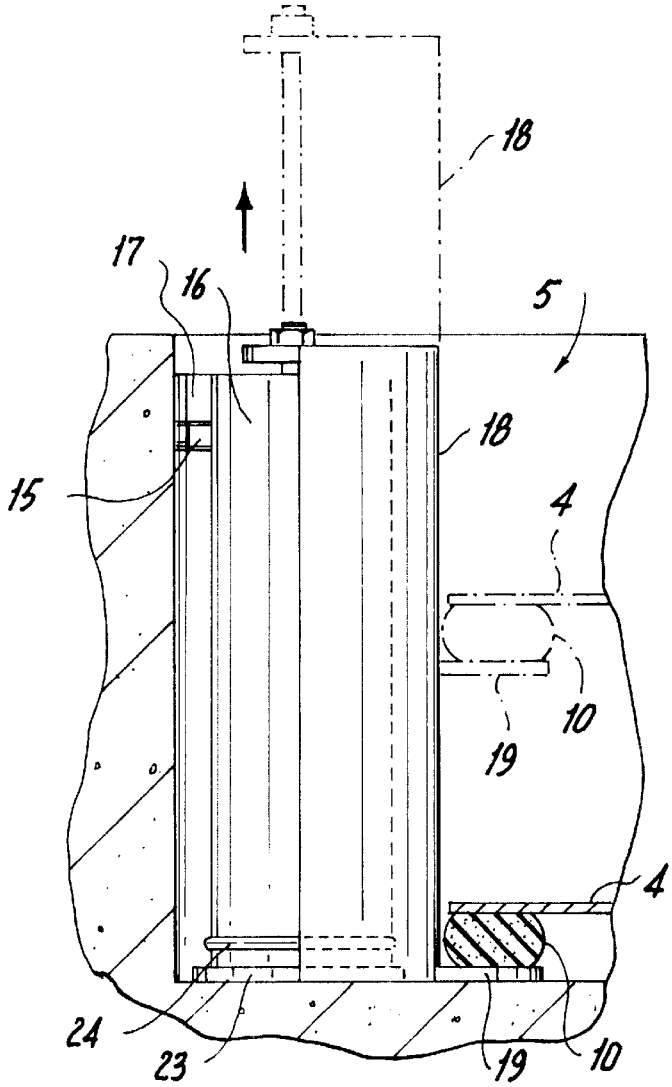
FIG. 5 is a side elevational view of a hydraulic submerging mechanism.

FIGS. 4 and 5 depict a hydraulic submerging mechanism 5. It is a hydraulic cylinder 16 of the order of 2.5" (63.5 mm) bore operated by pressurized pool water. Side baffles 17 are stationary members which blend into the pool sides. Pushing member 18 is attached to the cylinder 16 piston rod and forces down the edge of safety pool bottom 4 and its peripheral floatation 10 which is attached to mounting flange 19. Cylinder 16 is attached to pool bottom by flange 23. Ring 24 attached to pushing member 18 rides along the outside surface of cylinder 16 to counteract twisting moments; it guides member 18 in straight line motion in both up and down excursions.

The pressurized water enters the top of cylinder 16 at conduit 21 while dump valve 20 is opened by the triggering system to depressurize cylinder 16 permitting water above the internal piston to be dumped into the pool quickly thereby permitting the buoyant pool bottom structure 4 to rise.

Cylinder 16 is open at the bottom to permit water in cylinder 16 below the piston to enter or leave in a relatively unimpeded manner so as not to restrict motion.

Figure 6:
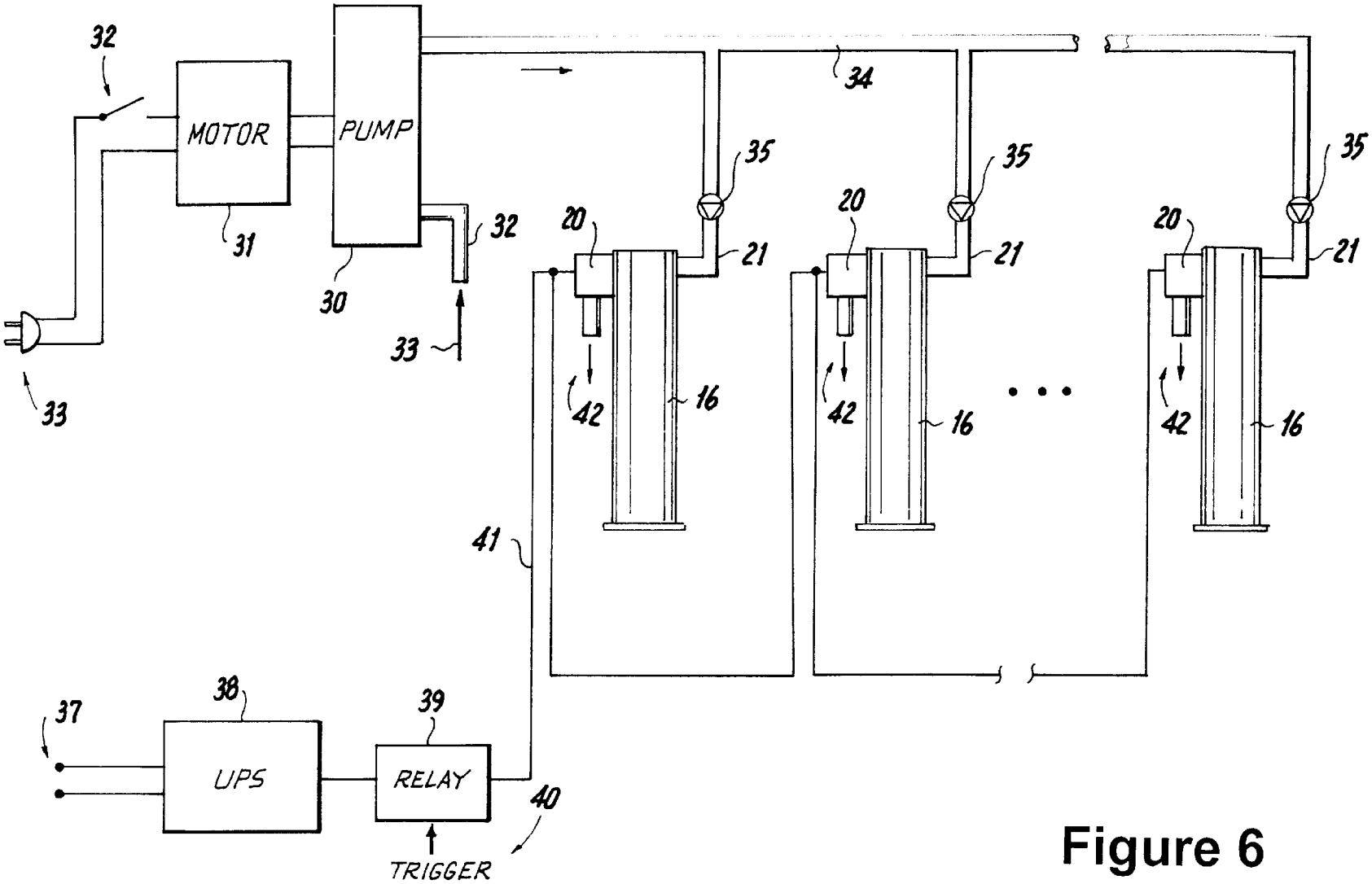
FIG. 6 is a block diagram of a hydraulic system embodiment of this invention.

FIG. 6 shows a system block diagram of the hydraulic and triggering system. A hard-wired electrical connection 37 to the supply mains is fed to a UPS 38 with internal storage battery. This, in turn, supplies power to a switching circuit 39 such as a relay which powers all dump valves 20 through conductor 41 (which is "daisy-chained") on all cylinders 16 if a trigger signal 40 is received from the detection circuit (not shown). When such a signal is received, water from cylinders 16 quickly escapes through discharge tubes 42 back into the pool.

Since there is now an unbalanced force, the safety pool bottom or net 4 rises quickly.

The detection system also has a manual switch which simulates an emergency for testing purposes or can be used in actual emergencies. The detectors themselves consist of any number of prior art devices including infrared/acoustic systems, acoustic transmitters with hydrophones, visual detection systems and so forth. Some of these systems incorporate computers and sophisticated detection software with time delays. The detection system is not claimed by this invention.

To redeploy the safety pool bottom or net 4 to the bottom of the pool after an emergency or test, a pump 30 is used to pressurize pool water 33 suctioned through inlet conduit 32 and discharged through pressurized conduit 34. Each cylinder 16 receives pressurized water through check valve 35. In this manner, the cylinder 16 will remain pressurized after pump 30 is stopped; indeed, conduit 34 can even be disconnected from each cylinder 16.

Actually, for small pools or above-ground pools with few cylinders 16, the entire deployment subsystem can be portable and removable. Motor 31 can be just plugged into an outlet at 33 with manual switch 32 turned on after conduit 34 is connected via "pigtails" to each cylinder. Subsystem consisting of motor 31 and pump 30 can be mounted on a wheeled carriage. Conduit 32 is simply a hose with its end dipped into the pool. A ½ HP motor can power a jet pump which would redeploy a safety net 4 in less than 2 minutes for a small pool. Of course, it is more convenient to have a permanently installed deployment subsystem, especially for large pools.

In an alternate embodiment, an electromechanical system is used for deployment (submerging) the safety pool bottom or net 4.

Figure 7:
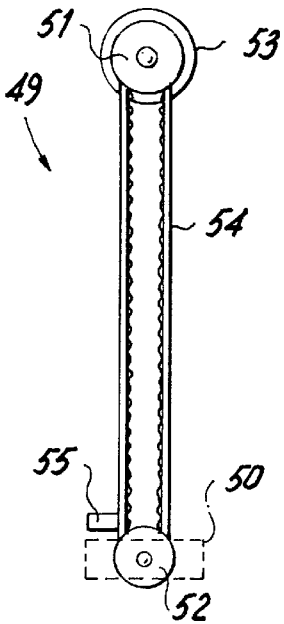
FIG. 7 is a front view of an alternate embodiment for an electromechanical submerging mechanism.

FIG. 7 shows the design of such an electromagnetic mechanism 49. These are distributed around the periphery of the pool just as the hydraulic units 5 above. Each mechanism 49 has a small gear motor 53, a drive belt pulley 51, timing belt 54, engagement nib 55 and bottom idler belt pulley 52. A member 50 which attaches to pool safety bottom 4 is held down by engagement nib 55 but is able to ride up along belt 54 by guidance rails (not shown) if nib 55 is permitted to rise. Motor 53 uses a worm gear in the gear train such that it will not be backdriven by the buoyant force of member 50.

The key to the operation of this system is that drive pulley 51 is driven by motor 53 through an electrically disengageable clutch such as a solenoid-operated wrap-spring clutch of known construction. Preferably motor 53 is unidirectional, a fact that reduces its cost by permitting the use of simple AC induction motors.

When an emergency is detected or a system test is performed, the clutch release mechanisms are energized (e.g. solenoids) which permit drive pulleys 51 to rotate freely (in a direction opposite to their motor driven direction). This releases tension on belt 54 allowing engagement nib 55 to rise under buoyant force from safety net 4 as transmitted by member 50.

Figure 8:
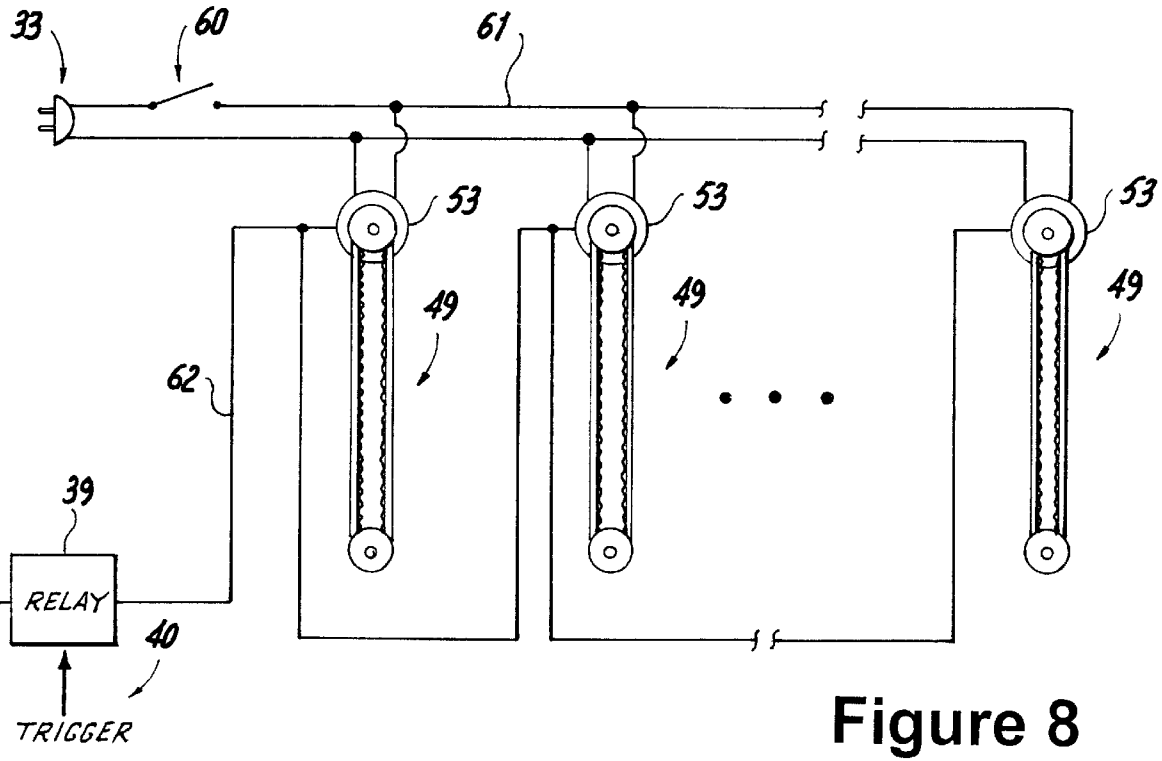
FIG. 8 is a block diagram of the electromechanical system embodiment thereof.

A block diagram of this alternate embodiment is shown in FIG. 8. As in the previous embodiment, hard wired electrical supply at 37 supplies power to UPS 38 which powers the triggering mechanisms through switching circuit 39 upon signals from detectors or manual switch 40. Line 62 is "daisy-chained" to each submerging mechanism triggering element such as a solenoid. For redeployment (submerging) plug 33 supplies AC mains power through manual switch 60 and conductors 61 to each motor 53 in each electromechanical submerging mechanism. Each submerging mechanism 49 has a switch which automatically turns motor 53 off when the bottom position is reached; alternatively, a stall detector can be used.

It is further noted that other modifications may be made to the present invention without departing from the scope of the invention, as noted in the appended claims.

What is claimed is:

1. A swimming pool rescue apparatus comprising:

a safety pool bottom substrate, said safety pool bottom substrate having a periphery made of a buoyant material and at least one non-peripheral portion is buoyant;

said buoyant material urged into a fixed position at a bottom of the pool by a retaining member, a lifting mechanism for raising and lowering said safety pool bottom substrate, wherein;

said lifting mechanism contains a plurality of vertically extending posts, each said vertically extending post having a respective pushing member riding axially along each respective vertically extending post, each said pushing member connected at a lower portion thereof to said periphery of said safety pool bottom substrate, said lifting mechanism communicating with an electronic signal device detecting the presence of a person under water in said pool for a predetermined period of time, said electronic signal device having a trigger engaging said lifting mechanism to release said buoyant material from said fixed position at said bottom of said pool to a further position at an upper area above the water level of said pool.

2. The swimming pool rescue apparatus as in claim 1 wherein said lifting mechanism is hydraulic.

3. The swimming pool rescue apparatus as in claim 2 wherein said hydraulic lifting mechanism is a plurality of cylinders having a bore therethrough, and said respective pushing makers have an inner surface conforming to an outer surface of each cylinder, each said pushing member connected to said safety pool bottom substrate by a flange.

4. The swimming pool rescue apparatus as in claim 3, wherein each said cylinder has as dump valve dumping pressurized water entering each cylinder at a top and thereof, thereby depressurizing each said cylinder and allowing said safety pool bottom to rise to the surface of said pool water, said bottom to rise to the surface of said pool water, said bottoms of each if said cylinders being open to allow easier access of water flow into and out of each said cylinder.

5. The swimming pool rescue apparatus as in claim 2 wherein said electromechanical lifting mechanism includes a plurality of cylinders having a drive belt pulley and timing belt riding along a guidance rail, said timing belt being connected to said safety pool bottom substrate.

6. The swimming pool rescue apparatus as in claim 1 wherein said safety pool bottom substrate is a flexible woven net having at least one buoyant member attached thereunder.

7. The swimming pool rescue apparatus as in claim 1 wherein said lifting mechanism is electromechanical.

8. The swimming pool rescue apparatus as in claim 1 wherein said buoyant material is a rigid closed cell foam.

9. The swimming pool rescue apparatus as in claim 8 wherein said buoyant material has a specific gravity of about 0.25 and has an area density of about 0.2 pounds per square foot.

10. A swimming pool rescue apparatus comprising:

a safety pool bottom, said safety pool bottom having a periphery made of buoyant material and at least one non-peripheral portion is buoyant;

a hydraulic mechanism for raising and lowering said safety pool bottom, wherein, said hydraulic mechanism contains a plurality of hydraulic cylinders, each of said plurality of cylinders having a bore therethrough, a top end, a flanged bottom end and said plurality of cylinders is in the pool and submerged in pool water, said flanged bottom end of each cylinder in said plurality of cylinders secures said plurality of cylinders to the bottom of the pool, a pushing member longitudinally extending through said top end of said each of cylinders;

each said pushing member contacting said periphery of said safety pool bottom, said each of said pushing member allowing said safety pool bottom to rise to about three inches from the surface of the pool and remain stationary and said safety pool bottom to lower to the bottom of the pool and remain stationary until said hydraulic mechanism is activated;

a ring for each of said cylinders interacting with each said flanged pushing member and the periphery of each said cylinder such that said ring rides longitudinally along the outer surface of one cylinder in said plurality of cylinders;

a dump valve for and connected to each cylinder in said plurality of cylinders dumping pressurized water entering each cylinder in said plurality of cylinders entering said top end of each said cylinder, thereby depressurizing said each of said cylinders and allowing said safety pool bottom to rise to the surface of the pool, said bottom of each of said cylinders is open to allow easier water flow into and out of said each cylinder in said plurality of cylinders; and an electrical triggering mechanism hardwired to said plurality of cylinders.

11. A swimming pool rescue apparatus as in claim 10 wherein said pool safety bottom having removable sections, said removable sections being foldable thereby allowing access to the bottom of the pool and said removable sections being configured to open by a key.

12. A swimming pool rescue apparatus as in claim 11 wherein said at least one non-peripheral portion made of buoyant material is at least one central floatation ring, said at least one central floatation ring has buoyant material at its periphery and said central portion having meshed openings.

13. A swimming pool rescue apparatus as in claim 10 wherein said safety pool bottom is a twenty-five percent open weave, and said non-peripheral buoyant portion is at least one buoyant tubular member under said weave.

14. A swimming pool rescue apparatus as in claim 13 wherein said weave is made of a fiber reinforced plastic straps.

15. A swimming pool rescue apparatus as in claim 14 wherein said weave is made of buoyant tubular members.

* * * * *